US006579064B2

(12) United States Patent
Hsieh

(10) Patent No.: US 6,579,064 B2
(45) Date of Patent: Jun. 17, 2003

(54) BLADE FOR A COOLING FAN

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 15 days.

(21) Appl. No.: 09/968,421

(22) Filed: Oct. 1, 2001

(65) Prior Publication Data

US 2003/0063974 A1 Apr. 3, 2003

(51) Int. Cl.[7] ..... F04D 29/30; F04D 29/38

(52) U.S. Cl. ..... 416/182; 416/179; 416/185; 416/228; 416/236 R; 416/238; 416/243; 416/223 R; 416/DIG. 2

(58) Field of Search ..... 416/238, 243, 416/228, DIG. 2, 223 R, 223 B, 235, 236 R, 179, 182, 183, 185

(56) References Cited

U.S. PATENT DOCUMENTS 4,569,631 A * 2/1986 Gray, III ..... 416/238
4,930,981 A * 6/1990 Walker ..... 416/228
5,979,541 A * 11/1999 Saito ..... 415/178
6,132,170 A * 10/2000 Horng ..... 415/178
6,179,561 B1 * 1/2001 Horng ..... 415/177
6,434,002 B1 * 8/2002 Wei ..... 415/176

* cited by examiner

*Primary Examiner*—Christopher Verdier

(57) ABSTRACT

A blade for a cooling fan is formed on an outer periphery of a rotor of the cooling fan and is curved. The blade has a convex outer surface and a concave inner surface. A curved angle of the blade between a line through the center of the rotor and a root of the convex outer surface and a line through the root and a tip of the convex outer surface is between 30° to 40°. A plane surface is formed on the concave inner surface and at a distal end of the blade. A first cutout is defined at a bottom side and a proximate end of the blade. A second cutout is defined at the upper side and the distal end of the blade.

4 Claims, 7 Drawing Sheets

BLADE FOR A COOLING FAN

BACKGROUND OF THE INVENTION

1. Field of the Invention

The present invention is related to a cooling fan, and more particularly to a blade for the cooling fan.

2. Description of Related Art

In cooling fans for electronic elements such as processors, or video display adapters etc, there is a type of lateral-blowing fan. External air is drawn in the fan through a vertical inlet and is driven by blades to blow out through a lateral outlet.

Referring to FIG. 7, a first conventional lateral-blowing fan has a housing, a stator, a rotor and cover. The housing has a lateral air outlet. The rotor has a hollow body with a brim. Several bladesare circumferentially formed on the brim. The cover has an air inlet defined therethrough. External air is drawn through the inlet of the cover and is blown out through the lateral outlet of the housing. However, a height of the cooling fan is large because the blades are provided under the cover. If a width of the blades is reduced to minimize the height of the cooling fan, a blowing capability of the cooling fan will be correspondingly decreased. Moreover, the original blowing capability of the cooling fan with this configuration of blades is small and the radiating effect is not good.

Referring to FIG. 8, a second conventional-blowing fan has blades obliquely formed on an outer periphery of a rotor. Each blade has an angle of about 45 degrees to a top face of the rotor. The vertical size of the second cooling fan is also large. If the angle of the blade is reduced to shorten the vertical size of the cooling fan, a blowing capability of the cooling fan also will be decreased.

Therefore, the invention provides an improved blade for a cooling fan to mitigate and/or obviate the aforementioned problems.

SUMMARY OF THE INVENTION

The main objective of the invention is to provide a blade for a cooling fan which can improve a radiating effect of the cooling fan.

Another objective of the invention is to provide a blade for a cooling fan which can achieve a compact height of the cooling fan.

Other objects, advantages and novel features of the invention will become more apparent from the following detailed description when taken in conjunction with the accompanying drawings.

DETAILED DESCRIPTION OF THE PREFERRED EMBODIMENT

Figure 1:
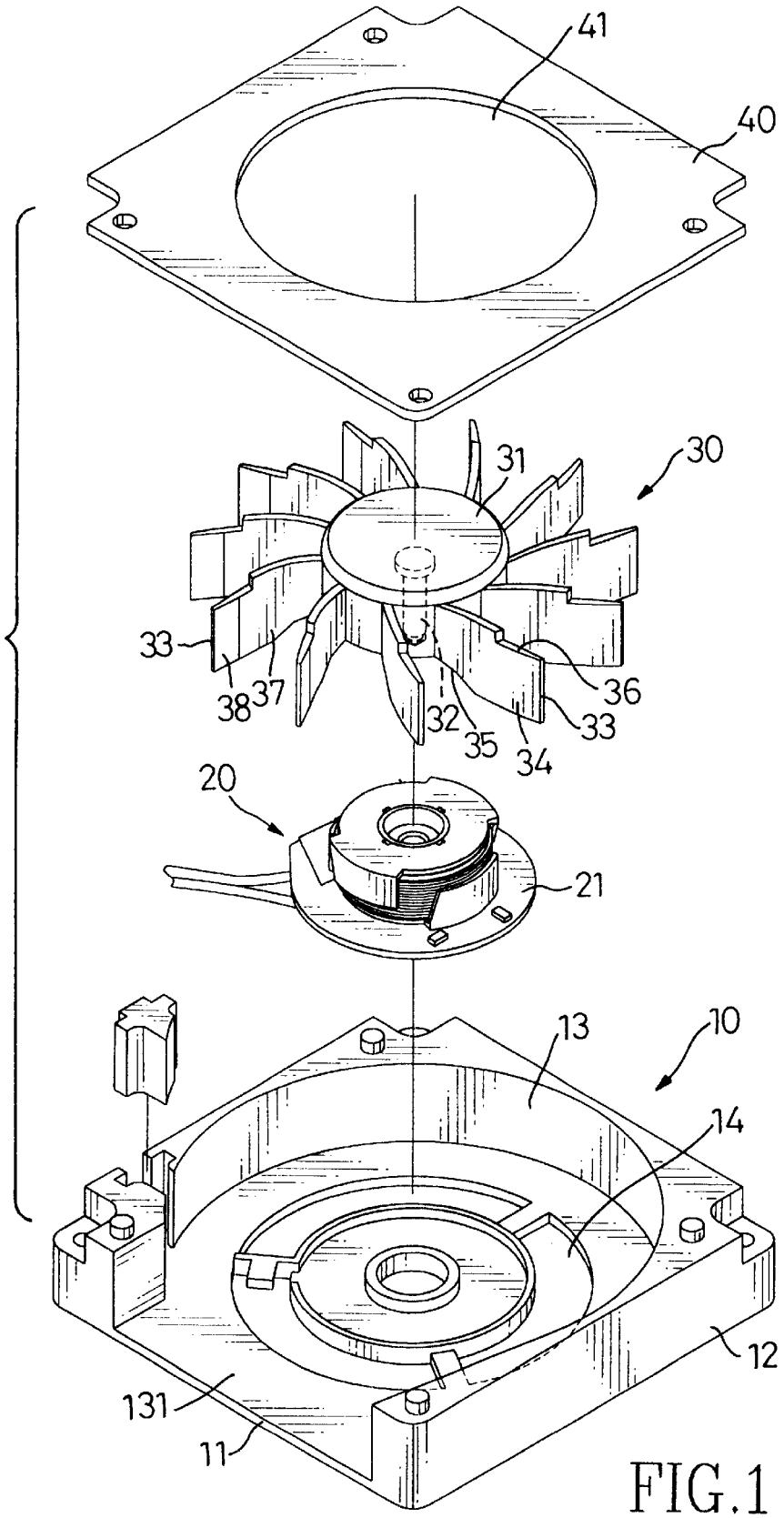
FIG. 1 is an exploded perspective view of a cooling fan in accordance with the invention.

With reference to FIG. 1, a lateral-blowing fan in accordance with the present invention is composed of a housing (10), a stator (20), a rotor (30) and a cover(40).

The housing (10) has a bottom plate (11) and a plurality of arcuate notches (14) is defined through the bottom plate (11). External air can flow in the housing (10) through the notches (14). Three contiguous side walls (12) are formed on the bottom plate (11) to define a circular chamber (13) in the housing (10) and an outlet (131) is defined between an opposed two of the side walls (12).

The stator (20) is received in the chamber (13) and has a circuit board (21) formed at a bottom thereof. The circuit board (21) is mounted on the bottom plate (11). The notches (14) are located outside the stator (20) and not covered by the circuit board (21).

The rotor (30) is also received in the chamber (13) and has a hollow body (31) covering the stator (20). A spindle (32) is formed at the center of the hollow body (31) and inserted in the stator (20) and is rotatable about the stator (20). Several blades (33) are radially formed on an outer periphery of the hollow body (31).

The cover (40) is mounted on the housing (10) and has an opening (41) defined therethrough. External air also can flow in the housing (10) through the opening (41).

Figure 2:
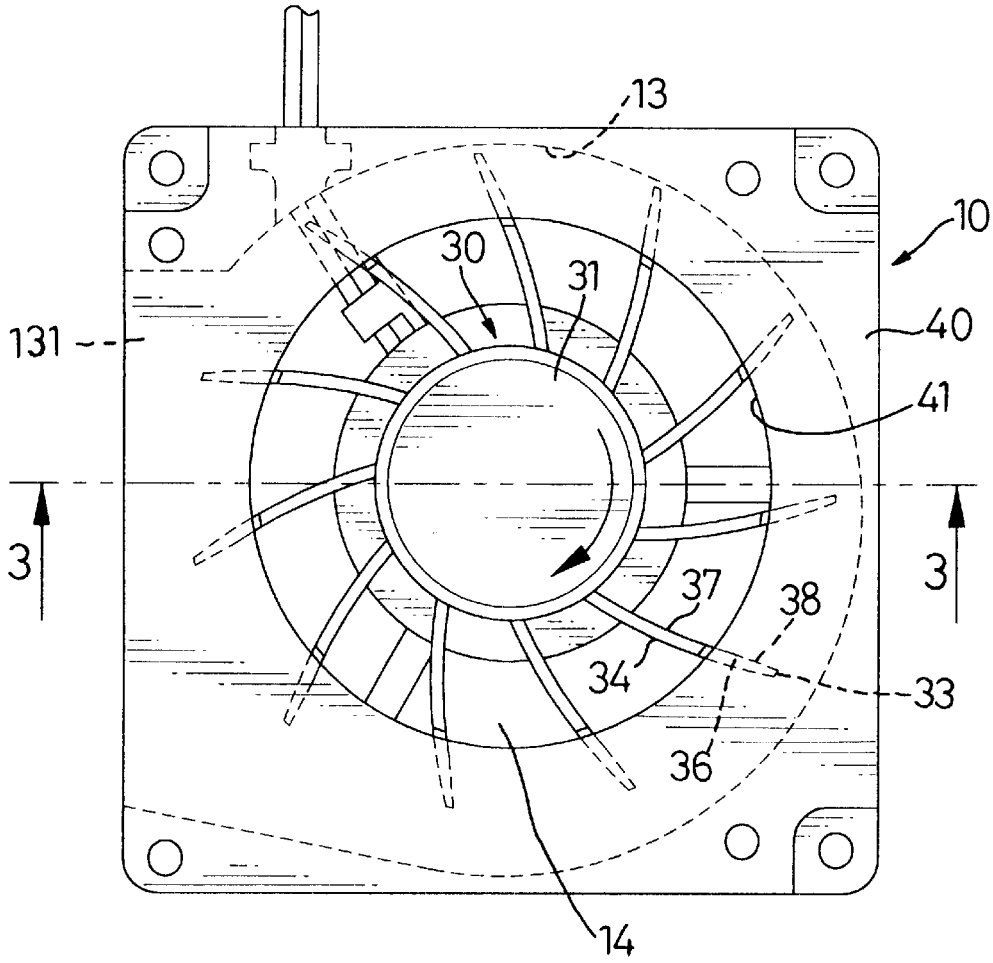
FIG. 2 is a top view of the cooling fan in FIG. 1.
Figure 3:
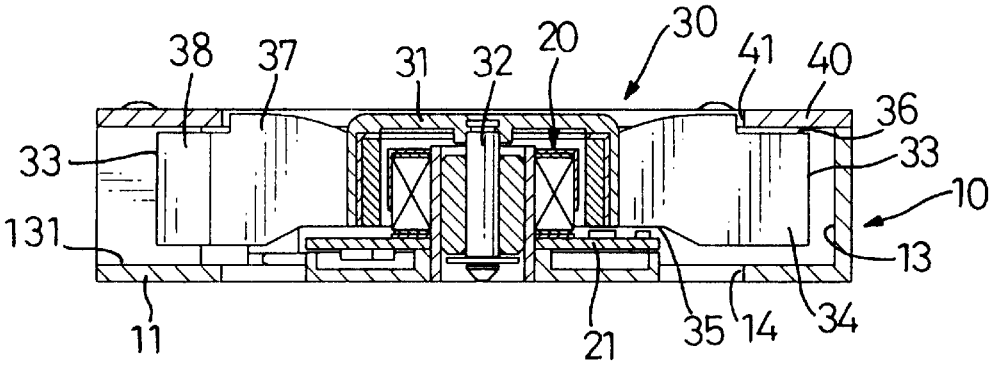
FIG. 3 is a cross sectional view of the cooling fan.

With reference to FIGS. 2 and 3, the rotor (30) is rotated counter-clockwise and each blade (33) is curved counter-clockwise. The blade (33) has a convex outer surface (34) and a concave inner surface (37). A first cutout (35) is defined at a bottom side and a proximate end of the blade (33) to prevent the blade (33) from meeting elements on the circuit board (21). A second cutout (36) is defined at an upper side and a distal end of the blade (33) to prevent the blade (33) from meeting the cover (40). An upper part behind the second cutout (36) of the blade (33) is extended in the opening (41). An area of the upper part behind the second cutout (36) substantially equals that of the first cutout (35), so that the overall area of the blade (33) is not decreased despite the cutouts (35, 36). A plane surface (38) is formed on the concave inner surface (37) and at the distal end of the blade (33).

Figure 4:
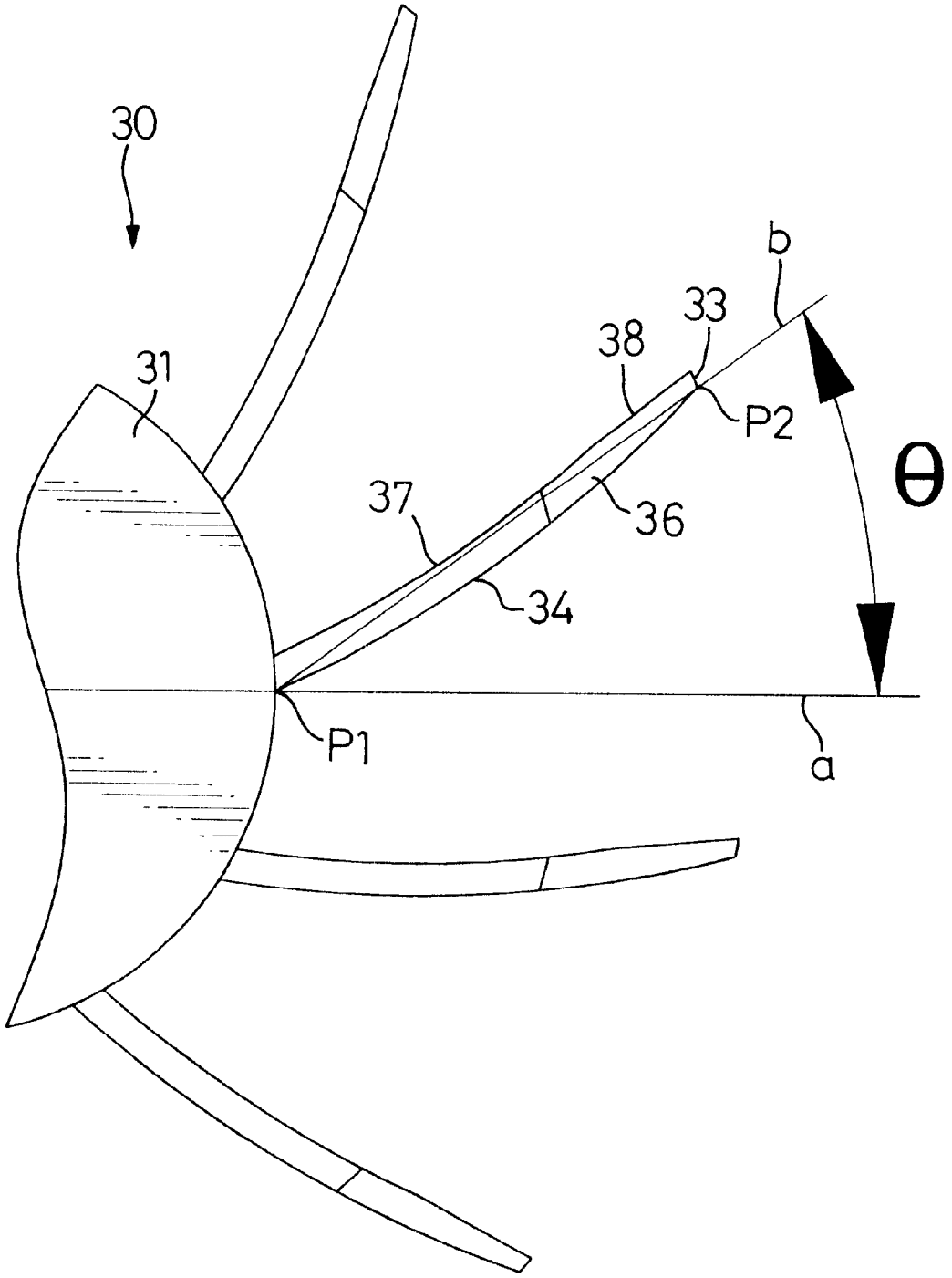
FIG. 4 is a schematic view of a central angle of a blade of the cooling fan.
Figure 5:
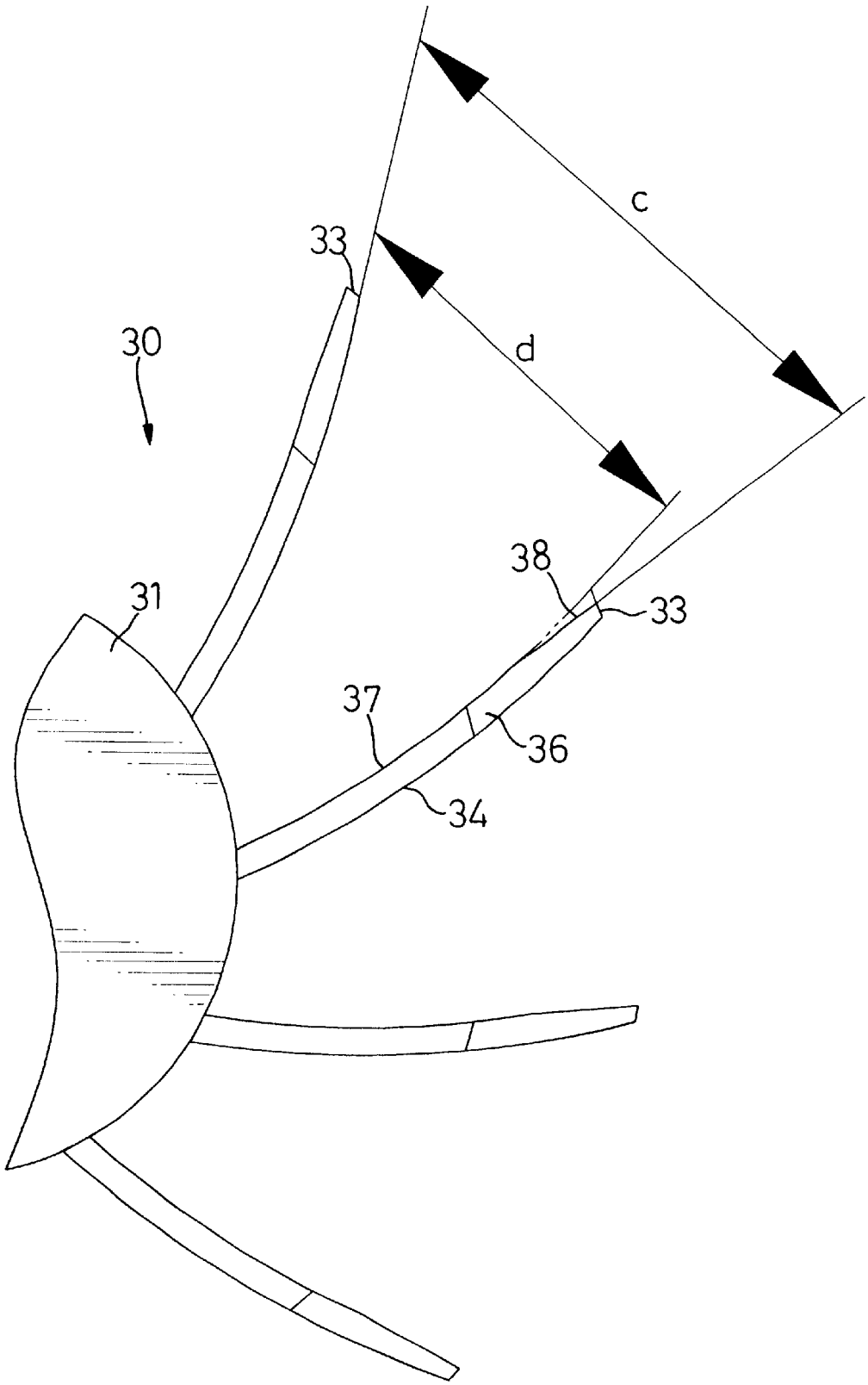
FIG. 5 is a schematic view showing a width between two adjacent blades.

With reference to FIGS. 4 and 5, a curved angle (θ) of the blade (33), between a line (a) through the center of the rotor (30) and a root (P1) of the convex outer surface (34) and a line (b) through the root (P1) and a tip (P2) of the convex outer surface (34), is between 30° to 40°. Two adjacent blades (33) have a distance (c) from the plane surface (38) of one blade (33) to the convex outer surface (34) of the next blade (33). The distance (c) is significantly wider than a distance (d) between two adjacent conventional blades without the plane surfaces (38) to increase the blowing capability of the cooling fan.

When the cooling fan is operated, air flows in the housing (10) via the notches (14) and the opening (41) and blows out by the blades (33) through the outlet (131).

Figure 6:
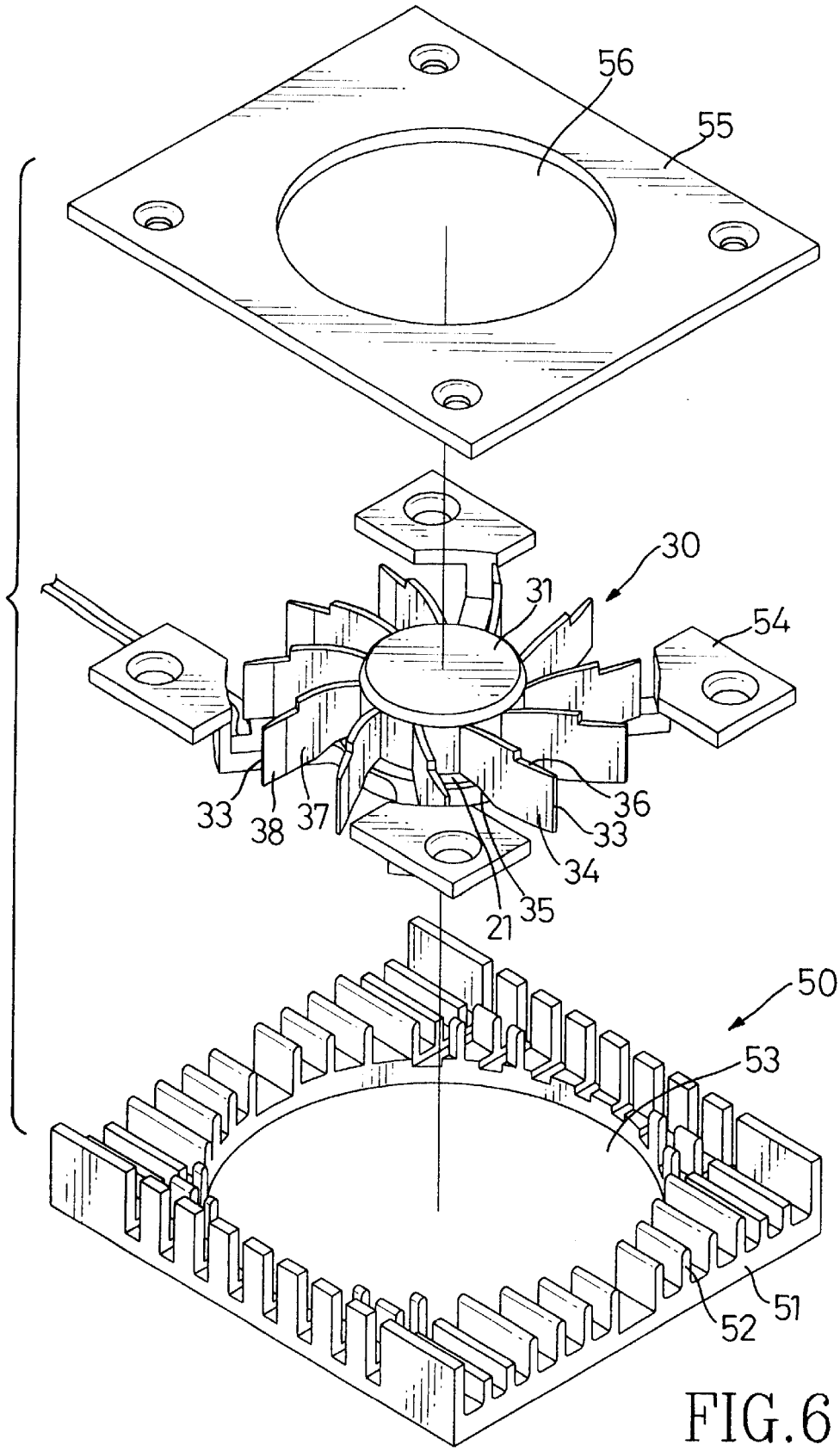
FIG. 6 is an exploded perspective view of another embodiment in accordance with the invention.
Figure 7:
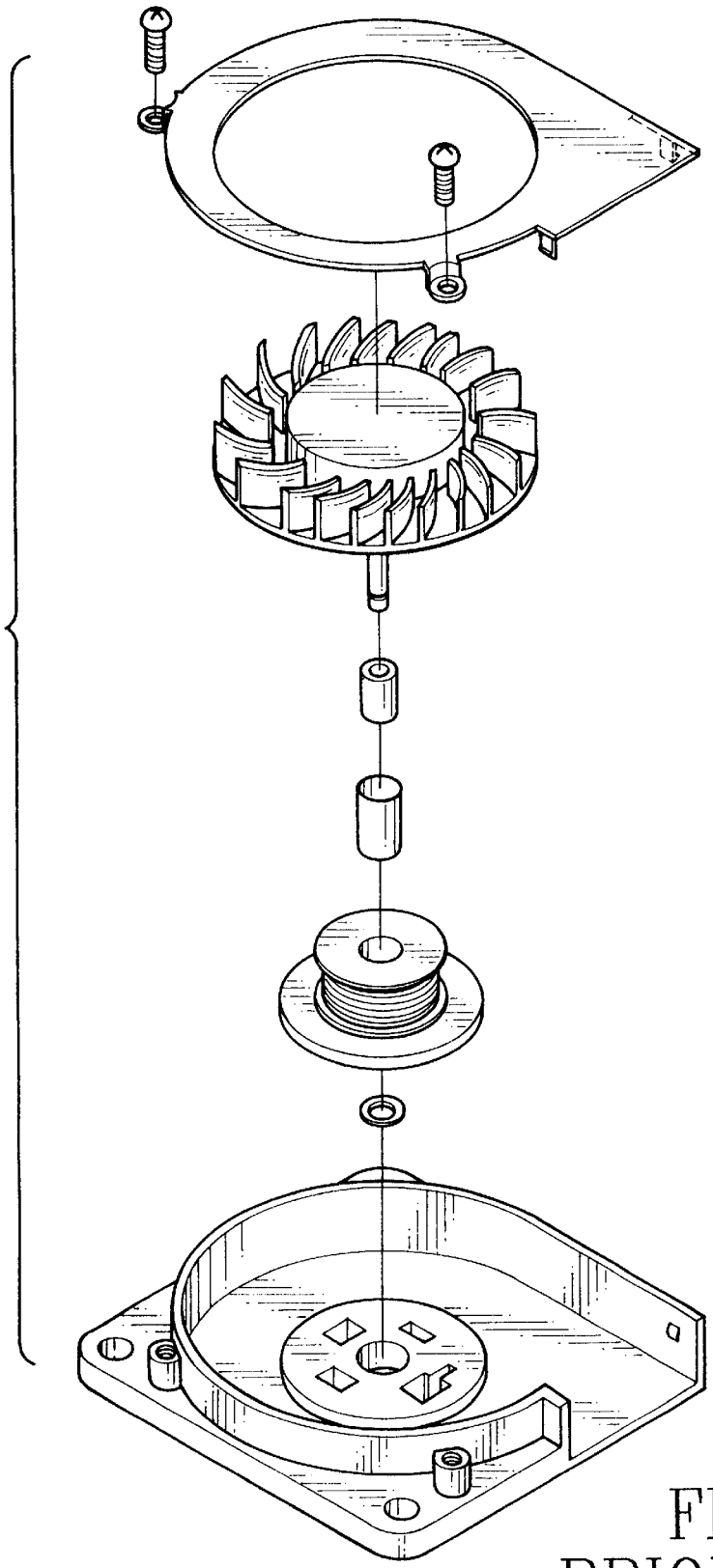
FIG.7 PRIOR ART
FIG. 7 is an exploded perspective view of a first conventional cooling fan.
Figure 8:
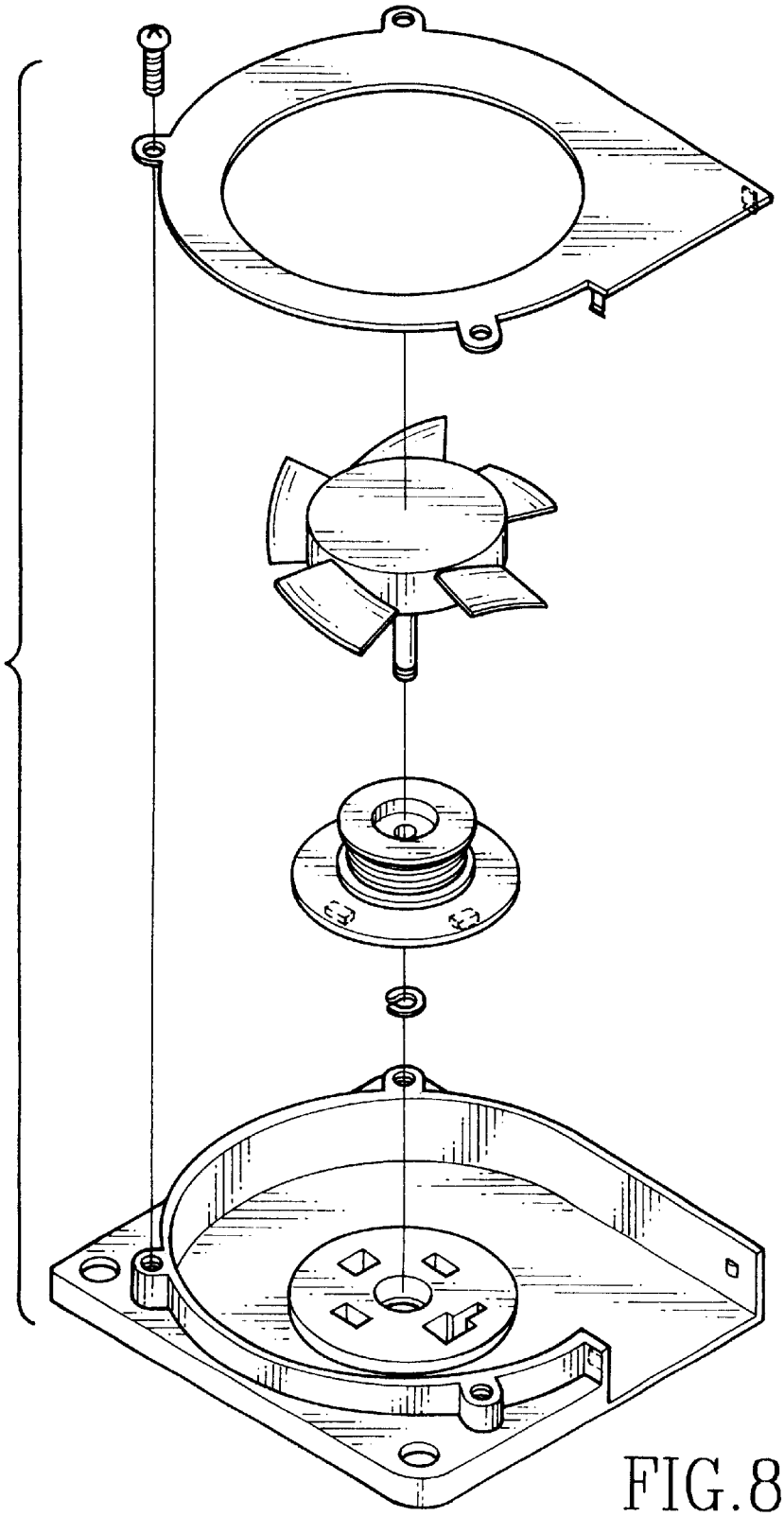
FIG.8 PRIOR ART
FIG. 8 is an exploded perspective view of a second conventional cooling fan.

Referring to FIG. 6, the blades (33) can used in another cooling fan. The cooling fan has a base (50) with a bottom plate (51). A plurality of fins (52) is formed on the bottom plate (51 ) and an air inlet (53) is defined at the center of the bottom plate (51). The rotor (30) is assembled on a bracket (54) and the bracket (54) is mounted on the fins (52) of the base (50). The blades (33) are formed on the outer periphery of the rotor (30). A cover (55) is mounted on the bracket (54) and has an opening (56) defined therethrough. The blades (33) are partially exposed from the opening (56).

When the cooling fan in FIG. 6 is operated, air flows through the base (50) via the inlet (53) and the opening (56) and blows out by the blades (33) through the gaps between the fins (52).

From the above description, it is noted that the invention has the following advantages:

1. Because two air inlets—the notches (14) and the opening (41)—are defined in the cooling fan, air flow-in capability is large.
2. Because the blades have optimized angle and curves, the cooling fan has a large blowing capability and a good radiating effect.
3. Because the blade has cutouts defined therein and can partially extend in the opening of the cover, the height of the cooling fan is small and the cooling fan is thin.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A blade for a cooling fan, the blade formed on an outer periphery of a hollow body of a rotor of the cooling fan and being curved, the blade (33) comprising:

a convex outer surface (34) and a concave inner surface (37), wherein a curved angle of the blade (33) between a line (a) through the center of the rotor and a root (P1) of the convex outer surface (34) and a line (b) through the root (P1) and a tip (P2) of the convex outer surface (34) is between 30° to 40°; and a plane surface (38) formed on the concave inner surface (38) and at an end distal from the hollow body of the rotor.

2. The cooling fan as claimed in claim 1, wherein the blade (33) has a first cutout (35) defined at a bottom side and an end proximate the hollow body of the rotor.

3. The cooling fan as claimed in claim 1, wherein the blade (33) has a second cutout defined at the upper side and an end distal from the hollow body of the rotor.

4. The cooling fan as claimed in claim 2, wherein the blade (33) has a second cutout defined at the upper side and an end distal from the hollow body of the rotor.

* * * * *